US011687020B2

(12) United States Patent
Imada et al.

(10) Patent No.: US 11,687,020 B2
(45) Date of Patent: Jun. 27, 2023

(54) HEATING DEVICE, FIXING DEVICE, AND IMAGE FORMING APPARATUS

(71) Applicants: Takahiro Imada, Kanagawa (JP); Yasunori Ishigaya, Kanagawa (JP); Shigeo Nanno, Kanagawa (JP); Takumi Waida, Kanagawa (JP); Daisuke Hirano, Kanagawa (JP)

(72) Inventors: Takahiro Imada, Kanagawa (JP); Yasunori Ishigaya, Kanagawa (JP); Shigeo Nanno, Kanagawa (JP); Takumi Waida, Kanagawa (JP); Daisuke Hirano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/501,290

(22) Filed: Oct. 14, 2021

(65) Prior Publication Data

US 2022/0155712 A1 May 19, 2022

(30) Foreign Application Priority Data

Nov. 16, 2020 (JP) ..... 2020-190116

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS

| | | | |
|---|---|---|---|
| 2019/0286026 | A1 | 9/2019 | Furuichi et al. |
| 2019/0286027 | A1 | 9/2019 | Someya et al. |
| 2020/0209791 | A1 | 7/2020 | Seki |

FOREIGN PATENT DOCUMENTS

| | | |
|---|---|---|
| JP | 2001-043956 | 2/2001 |
| JP | 2019-164328 | 9/2019 |
| JP | 2020-003611 | 1/2020 |
| JP | 2020-106666 | 7/2020 |

*Primary Examiner* — Thomas S Giampaolo, II
(74) *Attorney, Agent, or Firm* — Harness, Dickey & Pierce, P.L.C.

(57) ABSTRACT

A heating device includes a heating rotator, a pressure rotator, a planar heater, and a holder. The pressure rotator is configured to press against the fixing rotator to form a nip through which the recording medium is conveyed. The planar heater includes a plurality of heat generators arranged side by side and at least one separation region between the plurality of heat generators. The holder holds the planar heater and contacts the planar heater in a pressure direction in which the pressure rotator presses the heating rotator. The holder includes at least one clearance structure configured to cause a contact area between the planar heater and a portion of the holder corresponding to the at least one separation region to be smaller than a contact area between the planar heater and a portion of the holder not corresponding to the at least one separation region.

11 Claims, 7 Drawing Sheets

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119 to Japanese Patent Application No. 2020-190116, filed on Nov. 16, 2020 in the Japan Patent Office, the entire disclosure of which is hereby incorporated by reference herein.

BACKGROUND

Technical Field

Embodiments of the present disclosure generally relate to a heating device, a fixing device, and an image forming apparatus. In particular, the embodiments of the present disclosure relate to a heating device, a fixing device with the heating device for fixing a toner image on a recording medium, and an image forming apparatus with the fixing device for forming an image on a recording medium.

Related Art

A fixing device as a heating device includes a fixing belt as a belt and a planar heater heating the fixing belt. One type of such a heater includes a plurality of resistive heat generators arranged and electrically coupled in parallel to each other, as main heat generation portions.

SUMMARY

This specification describes an improved heating device that includes a heating rotator, a pressure rotator, a planar heater, and a holder. The pressure rotator is configured to press against the fixing rotator to form a nip through which the recording medium is conveyed. The planar heater includes a plurality of heat generators arranged side by side and at least one separation region between the plurality of heat generators. The holder holds the planar heater and contacts the planar heater in a pressure direction in which the pressure rotator presses the heating rotator. The holder includes at least one clearance structure configured to cause a contact area between the planar heater and a portion of the holder corresponding to the at least one separation region to be smaller than a contact area between the planar heater and a portion of the holder not corresponding to the at least one separation region.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
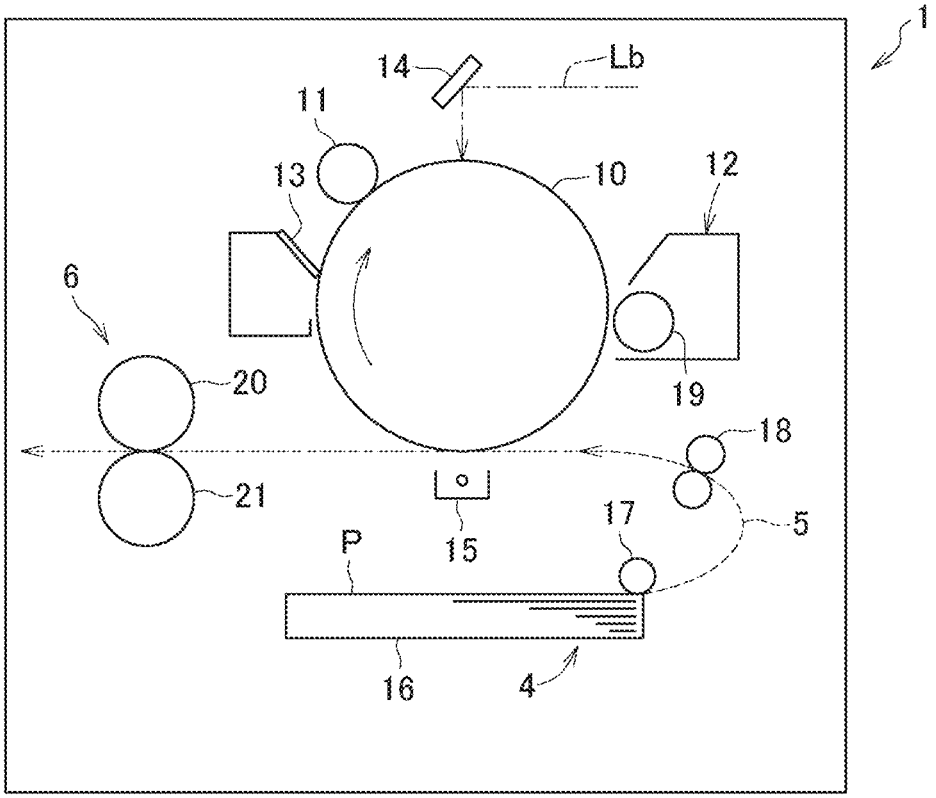
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

A description is provided of a heating device according to the present disclosure with reference to drawings. As one example of a heating device, the following describes a fixing device to fix a toner image onto a sheet. It is to be noted that the present disclosure is not to be considered limited to the following embodiments but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

As illustrated in FIG. 1, a monochrome image forming apparatus 1 includes a photoconductor drum 10. The photoconductor drum 10 bears toner as a developer on a surface of the photoconductor drum 10. The photoconductor drum 10 is a drum-shaped rotator rotatable in a direction indicated by arrow in FIG. 1. Around the photoconductor drum 10, the image forming apparatus 1 includes a charging roller 11, a developing device 12 including a developing roller 19, and a cleaning blade 13. The charging roller 11 uniformly charges the surface of the photoconductor drum 10. The developing roller 19 supplies toner to the surface of the photoconductor drum 10. The cleaning blade 13 cleans the surface of the photoconductor drum 10.

The image forming apparatus 1 includes an exposure device above a process unit including the photoconductor drum 10, the developing device 12, and the like. The exposure device emits laser light beams Lb based on image data. The exposure device irradiates the surface of the photoconductor drum 10 with the laser light Lb via a mirror 14.

The image forming apparatus 1 includes a transfer device 15 opposite the photoconductor drum 10. The transfer device 15 includes a transfer charger to transfer the toner image on the surface of the photoconductor drum 10 to a sheet P.

A sheet feeder 4 is disposed in a lower portion of the image forming apparatus 1. The sheet feeder 4 includes a sheet tray 16 and a sheet feeding roller 17. Downstream from the sheet feeding roller 17 in a sheet conveyance direction, registration rollers 18 are disposed. The sheet tray 16 accommodates sheets P as recording media. The sheet feeding roller 17 conveys the sheet P from the sheet tray 16 to a conveyance path 5.

The fixing device 6 includes a fixing belt 20 as a heating rotator, a pressure roller 21 as a pressure rotator, and a heater described below. The heater heats the fixing belt 20. The pressure roller 21 presses the fixing belt 20. The fixing belt 20 may be a fixing roller, and the pressure roller 21 may be a pressure belt.

Next, a description is given of a basic operation of the image forming apparatus 1 with reference to FIG. 1.

At the beginning of an image forming operation, the photoconductor drum 10 rotates, and the charging roller 11 charges the surface of the photoconductor drum 10. Subsequently, the exposure device irradiates the photoconductor drum 10 with the laser beam Lb based on the image data. An electric potential at a portion of the photoconductor drum 10 irradiated with the laser beam Lb decreases, and an electrostatic latent image is formed on the portion of the photoconductor drum 10. The developing device 12 supplies toner to the electrostatic latent image formed on the surface of photoconductor drum 10 to visualize the electrostatic latent image into a toner image, that is, a developer image. The transfer device 15 transfers the toner image onto the sheet P, and the cleaning blade 13 removes the toner remaining on the photoconductor drum 10 from the surface of the photoconductor drum 10.

On the other hand, as the image forming operation starts, the sheet feeding roller 17 of the sheet feeder 4 disposed in the lower portion of the image forming apparatus 1 is driven and rotated to feed the sheet P from the sheet tray 16 toward the registration rollers 18 through the conveyance path 5.

The registration rollers 18 are controlled to convey the sheet P fed to the conveyance path 5 to a transfer portion, timed to coincide with the toner image on the photoconductor drum 10. The transfer portion is a portion at which the transfer device 15 faces the photoconductor drum 10. The transfer device 15 applied a transfer bias transfers the toner image onto the surface of the sheet P conveyed to the transfer portion.

The sheet P bearing the toner image is conveyed to the fixing device 6. The heated fixing belt 20 and the pressure roller 21 heat and press the sheet P to fix the toner image onto the surface of the sheet P. The sheet P bearing the fixed toner image thereon is separated from the fixing belt 20, conveyed by a conveyance roller pair disposed downstream from the fixing device 6, and ejected to an output tray disposed outside the image forming apparatus 1.

Next, a configuration of the fixing device 9 is described.

Figure 2:
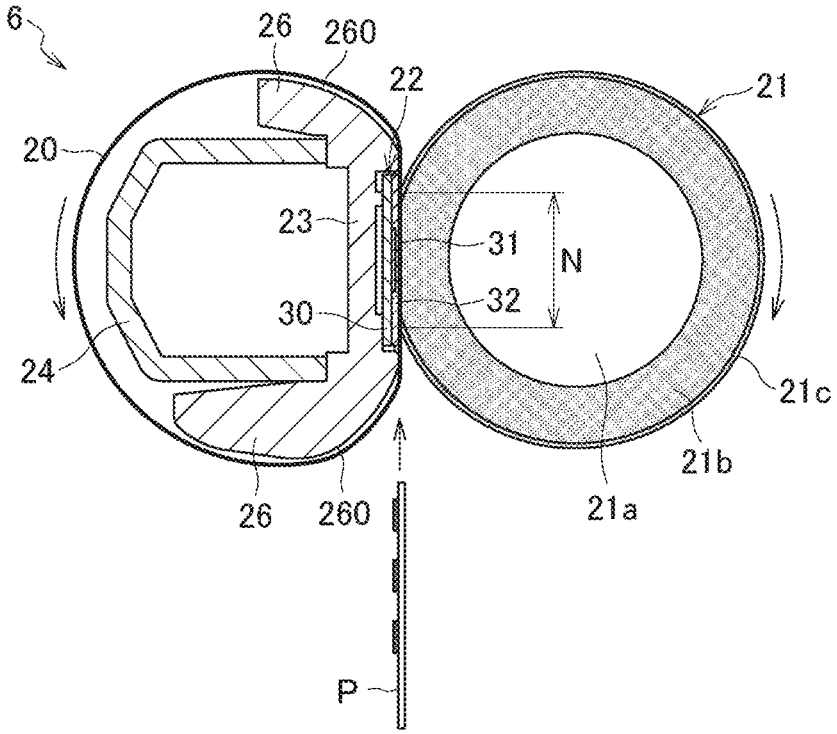
FIG. 2 is a schematic diagram illustrating a configuration of a fixing device according to an embodiment of the present disclosure.

As illustrated in FIG. 2, the fixing device 6 according to the present embodiment includes an endless fixing belt 20 as a fixing rotator, a pressure roller 21 as an opposed rotator or a pressure rotator, a heater 22, a heater holder 23 as a holder, a stay 24 as a support, and a thermistor as a temperature detector. The pressure roller 21 contacts the outer circumferential surface of the fixing belt 20 to form a fixing nip N as a nip. The heater 22 heats the fixing belt 20. The heater holder 23 holds the heater 22. The stay 24 supports a back side of the heater holder 23. A thermistor detects the temperature of the fixing belt 20. The fixing belt 20, the pressure roller 21, the heater 22, the heater holder 23, and the stay 24 extend in a direction perpendicular to the sheet surface of FIG. 2. Hereinafter, the direction is referred to as a longitudinal direction of each component or simply referred to as a longitudinal direction. The direction is also an axial direction of the pressure roller 21 and a width direction of the sheet P passing through the fixing device 6.

The fixing belt 20 includes, for example, a tubular base made of polyimide (PI), the tubular base having an outer diameter of 25 mm and a thickness of from 40 to 120 μm. On the outermost layer of the fixing belt 20, a release layer made of a fluorine-based resin, such as a perfluoroalkoxy alkane (PFA) or polytetrafluoroethylene (PTFE), having a thickness of from 5 to 50 μm, is formed in order to improve durability and ensure releasability. An elastic layer made of rubber having a thickness of from 50 to 500 μm may be interposed between the base and the release layer. The base of the fixing belt 20 may be made of heat resistant resin such as polyetheretherketone (PEEK) or metal such as nickel (Ni) and steel use stainless (SUS), instead of polyimide. An inner circumferential surface of the fixing belt 20 may be coated with polyimide, PTFE, or the like to produce a slide layer. The fixing belt 20 is a heated member heated by the heater 22.

The pressure roller 21 has an outer diameter of 25 mm, for example. The pressure roller 21 includes a core 21*a*, an elastic layer 21*b*, and a release layer 21*c*. The core 21*a* is a solid core made of iron. The elastic layer 21*b* coats the circumferential surface of the core 21*a*. The elastic layer 21*b* is made of silicone rubber and has a thickness of 3.5 mm, for example. The release layer 21*c* coats an outer circumferential surface of the elastic layer 21*b*. Preferably, the release layer 21*c* is a fluororesin layer having, for example, a thickness of approximately 40 μm to improve releasability of the surface of the pressure roller 21.

A biasing member presses the pressure roller 21 against the fixing belt 20, and the pressure roller 21 presses against the heater 22 via the fixing belt 20 to form the fixing nip N between the fixing belt 20 and the pressure roller 21. Additionally, a driver drives and rotates the pressure roller 21. As the pressure roller 21 rotates in a direction indicated by arrow in FIG. 2, the rotation of the pressure roller 21 drives the fixing belt 20 to rotate in a direction indicated by arrow in FIG. 2 due to frictional force therebetween.

The heater 22 is a planar heater extending in a longitudinal direction.

The heater 22 includes a planar base 30, resistive heat generators 31, and an insulation layer 32. The resistive heat generators 31 are disposed on the base 30. The insulation layer 32 covers conductors such as the resistive heat generators 31. The insulation layer 32 of the heater 22 contacts the inner circumferential surface of the fixing belt 20, and the heat generated from the resistive heat generators 31 is transmitted to the fixing belt 20 through the insulation layer 32.

The heater holder 23 and the stay 24 are disposed inside a loop of the fixing belt 20. The stay 24 is configured by a channeled metallic member, and both side plates of the fixing device 6 support both end portions of the stay 24. The stay 24 supports the heater holder 23 and the heater 22 held by the heater holder 23. As a result, the heater 22 reliably receives a pressing force of the pressure roller 21 pressed against the fixing belt 20 and stably forms the fixing nip N between the fixing belt 20 and the pressure roller 21.

Since the heater holder 23 is subject to temperature increase by heat from the heater 22, the heater holder 23 is preferably made of a heat resistant material. For example, the heater holder 23 may be made of a heat-resistant resin having a low thermal conductivity such as liquid crystal polymer (LCP). In such a case, the heater holder 23 reduces conduction of heat from the heater 22 to the heater holder 23, allowing the heater 22 to efficiently heat the fixing belt 20.

In addition, the heater holder 23 includes guides 26 (that is contact members) configured to guide the fixing belt 20. The guides 26 include upstream guides upstream from the heater 22 (that is under the heater 22 in FIG. 2) and downstream guides downstream from the heater 22 (that is over the heater 22 in FIG. 2) in a belt rotation direction. The upstream guides and the downstream guides of the guides 26 are disposed at intervals in a longitudinal direction of the heater 22 (see FIG. 11). Each guide 26 has a substantial fan shape and has a belt facing surface 260. The belt facing surface 260 faces the inner circumferential surface of the fixing belt 20 and is an arc-shaped or convex curved surface extending in a belt circumferential direction.

When the fixing device 6 according to the present embodiment starts a print operation, the pressure roller 21 is driven to rotate, and the rotation of the pressure roller 21 rotates the fixing belt 20 as illustrated in FIG. 2. The belt facing surface 260 of the guide 26 contacts and guides the inner circumferential surface of the fixing belt 20 to stably and smoothly rotates the fixing belt 20. As power is supplied to the resistive heat generators 31 of the heater 22, the heater 22 heats the fixing belt 20. After the temperature of the fixing belt 20 reaches a predetermined target temperature (i.e., a fixing temperature), the sheet P bearing an unfixed toner image is conveyed to the fixing nip N between the fixing belt 20 and the pressure roller 21, and the unfixed toner image is heated and pressed onto the sheet P and fixed thereon.

Next, a detailed description is given of the configuration of the heater 22.

Figure 3:
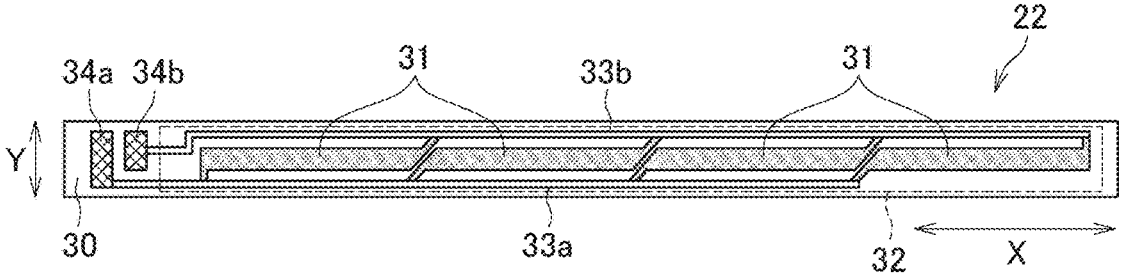
FIG. 3 is a plan view of a heater incorporated in the fixing device of FIG. 2.

As illustrated in FIG. 3, the heater 22 includes a planar base 30. On the planar base 30, the heater 22 includes a plurality of resistive heat generators 31 (four heat generators 31), power supply lines 33*a* and 33*b* that are conductors, a first electrode 34*a*, and a second electrode 34*b*. In addition, the heater 22 includes the insulation layer 32 that covers the surface of the base 30 and conductor portions of the above-described parts to insulate the base 30 and the conductor portions.

The material of the base 30 is preferably ceramic such as alumina or aluminum nitride, glass, mica, and heat-resistant resin such as polyimide (PI) that have excellent thermal resistance and insulating properties. The base 30 may be made by layering the above-described insulation material on conductive material. For example, the conductive material to make the base 30 is preferably a material having a high thermal conductivity such as aluminum, copper, silver, graphite, or graphene. In these materials, high thermal conduction uniforms the temperature of the entire heater, improving an image quality.

The material of the resistive heat generator 31 and the power supply lines 33*a* and 33*b* may be silver (Ag), palladium (Pd), platinum (Pt), or ruthenium oxide (e.g., $RuO_2$). The resistive heat generators 31 and the power supply lines 33*a* and 33*b* can be formed by applying a conductive material paste prepared by mixing the above-described materials to the base 30 by screen printing or the like, and then firing the base 30.

In the above, the resistive heat generators 31 are main heat generation portions of the heater 22. When a voltage of 40% of the rated voltage is applied to the fixing device 6 for three seconds, the temperature of the resistive heat generators 31 rises by 100 degrees or more.

The insulation layers 32 may be made of ceramics such as alumina and aluminum nitride, glass, mica, and heat-resistant resin such as polyimide. These materials are preferable for the insulation layer 32 because of excellent heat resistance and insulation properties.

The resistive heat generators 31 are coupled to the first electrode 34*a* through the power supply line 33*a* and the second electrode 34*b* through the power supply line 33*b*. The resistive heat generators 31 are electrically coupled in parallel. In the present embodiment, the plurality of resistive heat generators 31 are arranged in a line in the above-described longitudinal direction X. Hereinafter, the longitudinal direction X is also referred to as an arrangement direction of the plurality of resistive heat generators 31 or simply referred to as the arrangement direction. In addition, a direction intersecting the arrangement direction (in the present embodiment, the vertical direction), the direction different from a thickness direction of the base 30 that is the vertical direction Y in FIG. 3 is referred to as a direction intersecting the arrangement direction of the plurality of resistive heat generators 31 or simply referred to as the direction intersecting the arrangement direction. The direction intersecting the arrangement direction is also a short-side direction of the heater 22.

The resistive heat generator 31 has a positive temperature coefficient (PTC) characteristic. The PTC characteristic is a characteristic in which the resistance value increases as the temperature increases, for example, a heater output decreases under a given voltage. The resistive heat generator 31 having the PTC characteristic increases the output of the heater 22 under low temperature and can rapidly increase the temperature of the fixing belt 20. In contrast, the resistive heat generator 31 having the PTC characteristic decreases the output of the heater 22 under high temperature and can prevent overheating of the fixing belt 20 in a non-sheet conveyance area caused by continuously printing small sheets.

Figure 4:
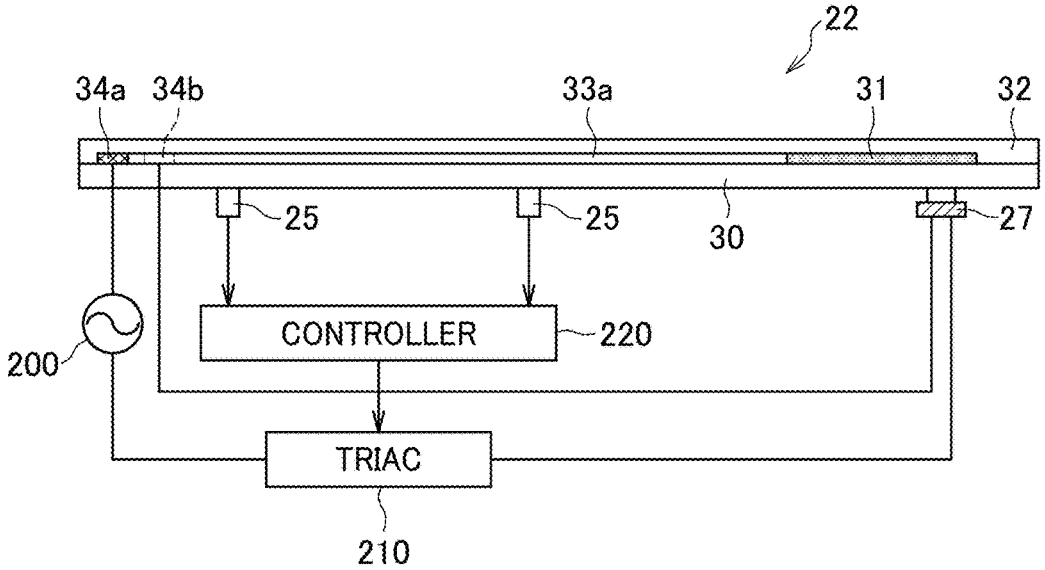
FIG. 4 is a schematic diagram illustrating a circuit to supply power to the heater according to an embodiment of the present disclosure.

As illustrated in FIG. 4, an alternating current power supply 200 is electrically coupled to the first electrode 34*a* and the second electrode 34*b* of the heater 22 to configure a power supply circuit to supply power to the resistive heat generators 31. The power supply circuit includes a triac 210 that controls the amount of power supplied. A controller 220 is configured by a microcomputer including a central processing unit (CPU), a read only memory (ROM), a random-access memory (RAM), an input and output (I/O) interface, and the like.

In the present embodiment, one thermistor 25 is disposed in the central region in the arrangement direction of the heaters 22 that is the region inside a sheet conveyance span for the smallest sheet, and the other thermistor 25 is disposed in one end portion of the heater 22 in the arrangement direction. Additionally, a thermostat 27 as a power cut-off device is disposed in the other end portion of the heater 22 in the arrangement direction. The thermostat 27 cuts off power supply to the resistive heat generators 31 when the temperature of the resistive heat generator 31 becomes a predetermined temperature or higher. The thermistors 25 and the thermostat 27 are in contact with a back side of the base 30 (that is a side opposite to a side on which the resistive heat generators 31 are disposed) to detect the temperatures of the heater 22.

The controller 220 controls an amount of power supplied to the resistive heat generators 31 via a triac 210. The controller 220 determines the amount of power supplied to the resistive heat generators 31 based on temperatures detected by the thermistors 25. When the sheet P passes through the fixing device 6, the controller 220 determines the amount of power supplied considering a heat amount absorbed by the sheet P.

The first electrode 34*a* and the second electrode 34*b* are disposed on the same end portion of the base 30 in the present embodiment but may be disposed on both end portions of the base 30. The shape of resistive heat generator 31 is not limited to the shape in the present embodiment. For example, as illustrated in FIG. 5, the shape of resistive heat generator 31 may be a rectangular shape, or as illustrated in FIG. 6, the resistive heat generator 31 may be configured by a linear portion folding back to form a substantially parallelogram shape.

Figure 7:
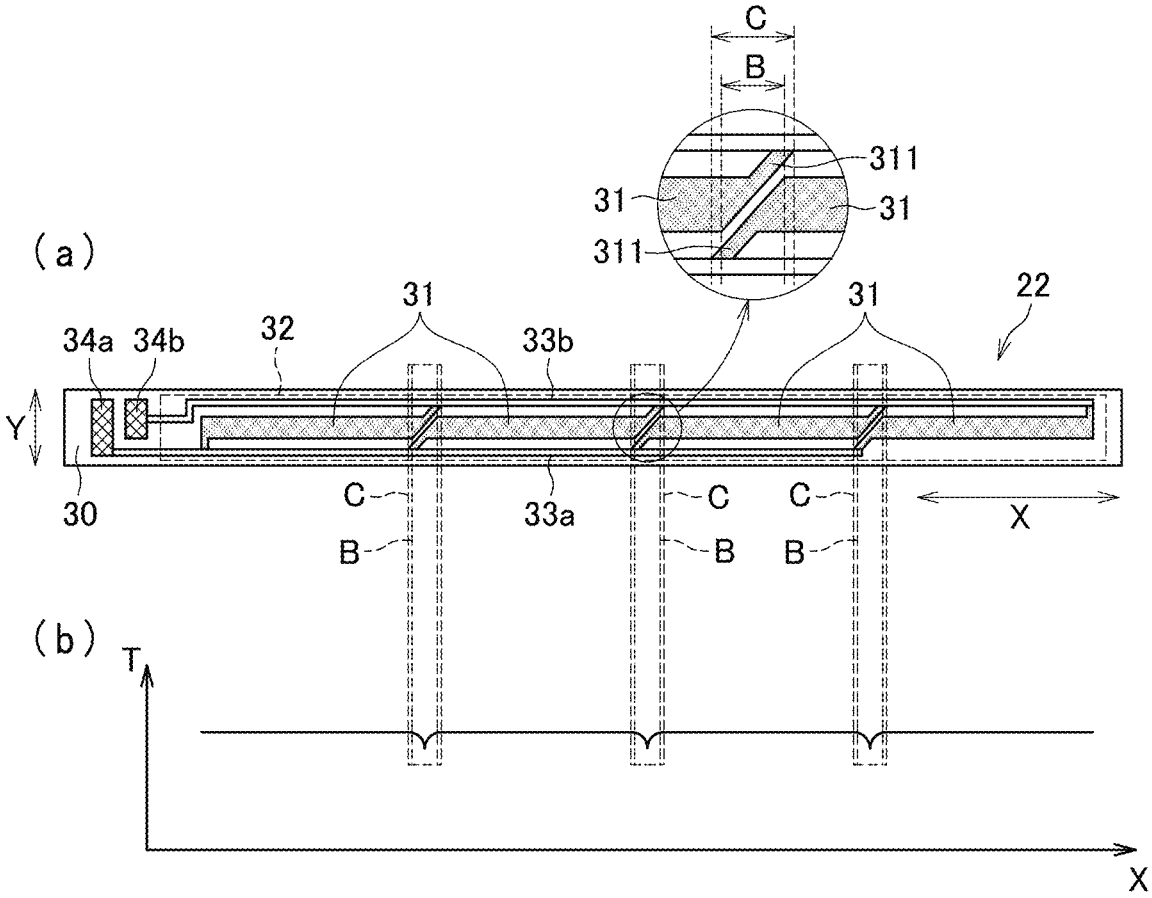
FIG. 7 is a diagram illustrating a positional relation between an arrangement of the heat generators of the heater and a temperature distribution of a fixing belt in an arrangement direction of the heat generators.

FIG. 7 is a diagram illustrating a temperature distribution of the fixing belt 20 in the arrangement direction. FIG. 7(*a*) is a diagram illustrating an arrangement of the heat generators 31 of the heater 22. FIG. 7(*b*) is a graph, a vertical axis represents the temperature T of the fixing belt 20, and a horizontal axis represents the position of the fixing belt 20 in the arrangement direction.

As illustrated in FIG. 7(*a*), the heater 22 has separation regions B each of which is a portion between the resistive heat generators 31 in the arrangement direction and enlarged separation regions C each of which includes the separation region B and the periphery of the separation region B. The area occupied by the resistive heat generators 31 in the separation region B or the enlarged separation region C is smaller than the area occupied by the resistive heat generator 31 in any one of other regions on the resistive heat generator 31. Therefore, a heat generation amount in the separation region B or the enlarged separation region C is smaller than a heat generation amount in one of the other regions. As a result, the temperature of the fixing belt 20 on the separation region B becomes smaller than the temperature of the fixing belt 20 on the other region, which causes temperature unevenness in the arrangement direction of the fixing belt 20 as illustrated in FIG. 7(*b*). Similarly, the temperature of the heater 22 decreases in the separation regions B or the enlarged separation regions C. With reference to an enlarged partial view of FIG. 7(*a*), the separation region B is defined as a region in the arrangement direction sandwiched between the resistive heat generators 31 that are the main heat generation portions of the heater 22. The enlarged separation region C is defined as a region including a range corresponding to connection portions 311 of the resistive heat generators 31 in addition to the separation region B. The connection portion 311 is defined as a portion of the resistive heat generator 31 that extends in the direction intersecting the arrangement direction and is connected to one of the power supply lines 33*a* and 33*b*.

Figure 5:
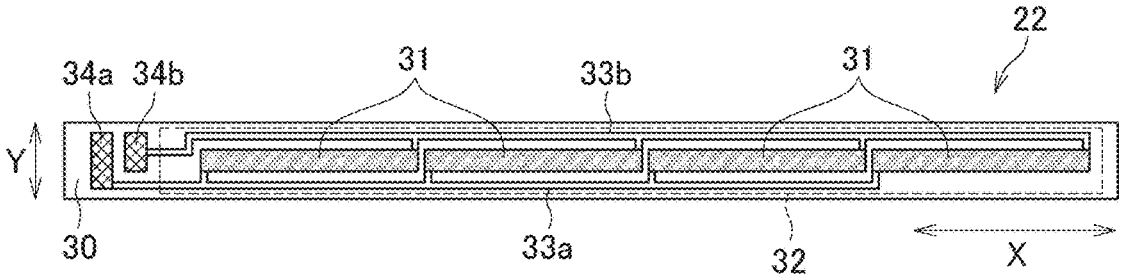
FIG. 5 is a plan view of the heater including heat generators each having a form different from the forms of the heat generators illustrated in FIG. 3.
Figure 6:
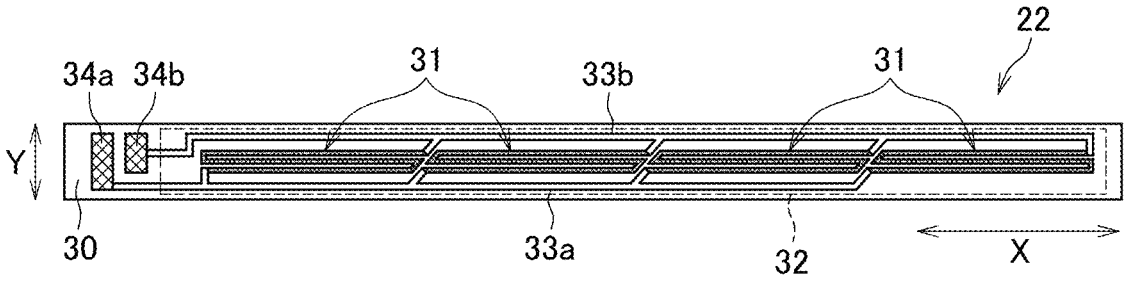
FIG. 6 is a plan view of the heater including heat generators each having a form different from the forms of the heat generators illustrated in FIG. 3.
Figure 8:
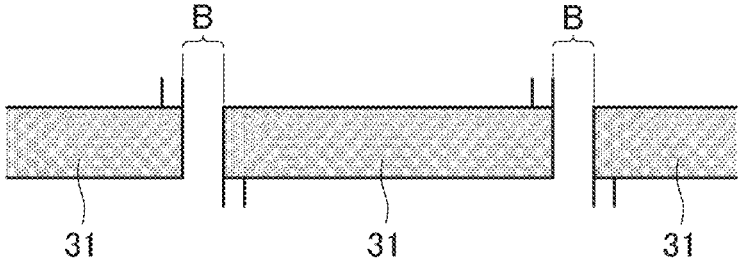
FIG. 8 is a diagram illustrating separation regions of the heater of FIG. 5.
Figure 9:
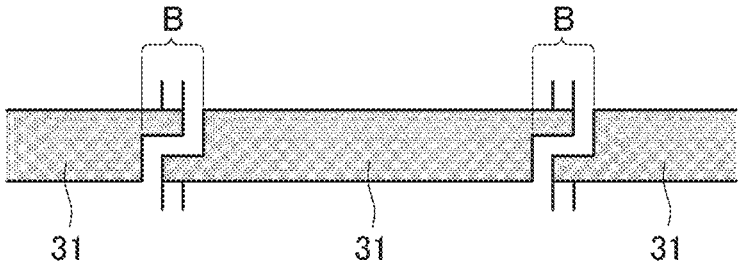
FIG. 9 is a diagram illustrating separation regions different from the separation regions illustrated in FIG. 8.
Figure 10:
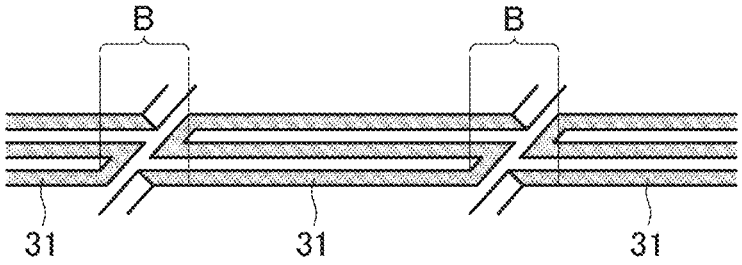
FIG. 10 is a diagram illustrating separation regions of the heater of FIG. 6.

As illustrated in FIG. 8, the heater 22 including the rectangular resistive heat generators 31 illustrated in FIG. 5 also has the separation regions B having lower temperatures than the other regions. In addition, the heater 22 including the resistive heat generators 31 having forms as illustrated in FIG. 9 has the separation regions B with lower temperatures than the other regions. As illustrated in FIG. 10, the heater 22 including the resistive heat generators 31 having forms as illustrated in FIG. 6 has the separation regions B with lower temperatures than the other regions. However, overlapping the resistive heat generators 31 lying next to each other in the arrangement direction as illustrated in FIGS. 7, 9, and 10 can reduce the above-described temperature drop that the temperature of the fixing belt 20 above the separation region B is smaller than the temperature of the fixing belt 20 above a region other than the separation region B. Note that the heater 22 including the resistive heat generators 31 as illustrated in one of FIGS. 8 to 10 does not have the enlarged separation region C (that is, the enlarged separation region C is the same range as the separation range B) because the resistive heat generators 31 as illustrated in FIGS. 8 to 10 do not have the connection portion 311 (see FIG. 7), portions extending in the direction intersecting the arrangement direction are power supply lines, and, additionally, in FIGS. 8 and 9, the connection portions extend in a direction orthogonal to the arrangement direction (that is the vertical direction in FIGS. 8 and 9).

Next, the heater holder 23 that holds the heater 22 is described in detail, and then the structure of the heater holder 23 that reduces the temperature drop regarding the separation region B is described.

Figure 11:
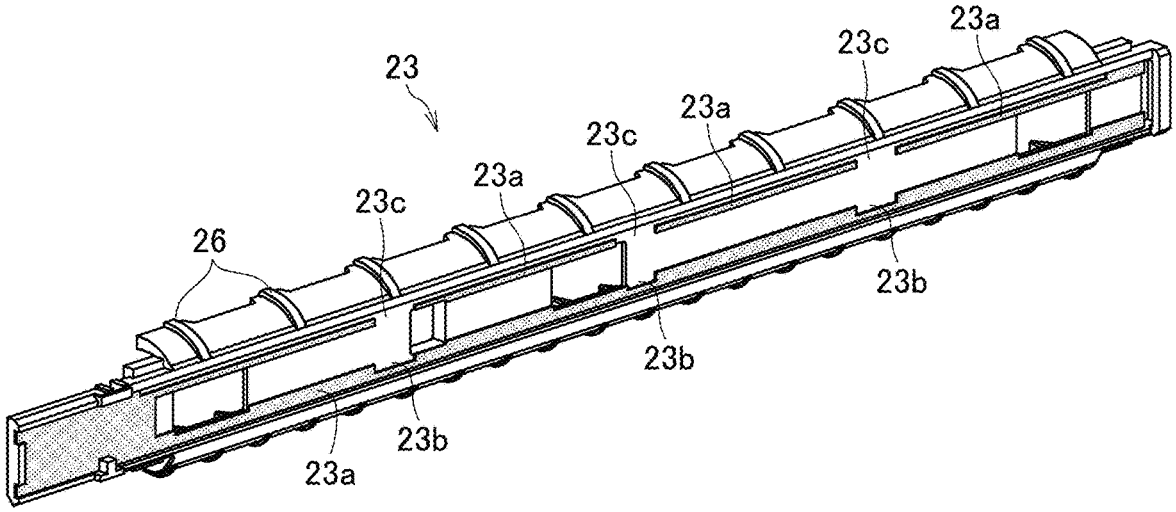
FIG. 11 is a perspective view of a heater holder.

As illustrated in FIG. 11, the heater holder 23 includes a contact portion 23*a* contacting the back side of the base 30 of the heater 22 (see hatched parts in FIG. 11). The contact portion 23*a* extends in the arrangement direction and protrudes in a pressure direction in which the pressure roller 21 presses against the fixing belt 20. The pressure direction is the left-right direction in FIG. 2 and is hereinafter also simply referred to as the pressure direction. The pressure direction is also a thickness direction of the heater holder 23 and a direction in which the pressure roller 21 approaches the heater holder 23. The contact portion 23*a* extending in the arrangement direction is in contact with the back side of the base 30 in the pressure direction. The heater holder 23 has a through-hole extending in the pressure direction at a position corresponding to the above-described thermistor or thermostat.

The heater holder 23 includes the contact portions 23*a* on both sides of the heater holder 23 in the direction intersecting the arrangement direction and does not include the contact portion 23*a* on a center portion of the heater holder 23 in the direction intersecting the arrangement direction to form a non-contact portion on the center portion. Forming the non-contact portion that is not in contact with the base 30 on the center portion of the heater holder 23 in a short-side direction of the heater holder 23 decreases an area in which the heater holder 23 is in contact with the base 30 and reduces the heat transferred from the heater 22 to the heater holder 23. In one end portion of the heater holder 23 in the arrangement direction (that is a left end portion of the heater holder 23 in FIG. 11), the center portion of the heater holder 23 in the direction intersecting the arrangement direction is in contact with the base 30 because the sheet does not pass near the one end portion, and the resistive heat generator 31 is not disposed on a portion of the heater 22 corresponding to the one end portion, which means that the heat amount transferred from the heater 22 to the heater holder 23 is small.

The heater holder 23 includes a plurality of clearance structures arranged in the arrangement direction and configured to decrease a contact area in which the heater 22 is in contact with the heater holder 23 in the pressure direction. One of the clearance structures in the present embodiment is a notch 23*b* formed in an upstream portion of the heater holder 23 in a sheet conveyance direction (that is a lower portion of the heater holder 23 in FIG. 11) so as to reduce the width of the contact portion 23*a* in the direction intersecting the arrangement direction. The other one of the clearance structures in the present embodiment is formed by a non-contact portion 23*c* formed in a downstream portion of the heater holder 23 in the sheet conveyance direction. Removing a part of the contact portion 23*a* so that the width of the contact portion 23*a* is equal to 0 in the direction intersecting the arrangement direction at the part forms the non-contact portion 23*c* that does not bring the heater holder 23 into contact with the heater 22 at the part in the arrangement direction.

Figure 12:
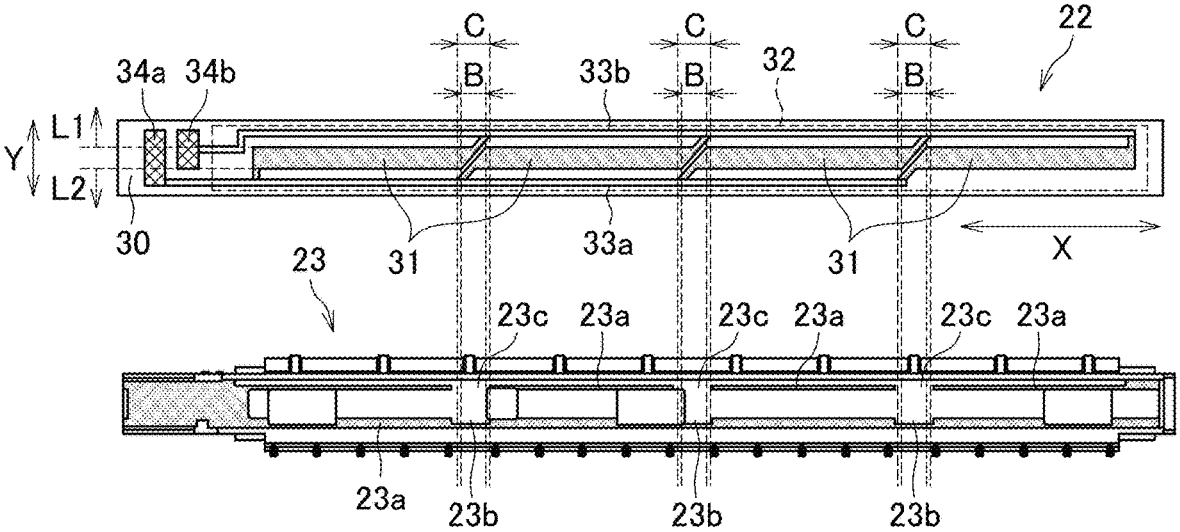
FIG. 12 is a plan view of a heater holder and the plan view of the heater, illustrating a positional relation in the arrangement direction between the heater and the heater holder.

As illustrated in FIG. 12, the notch 23*b* and the non-contact portion 23*c* as the clearance structures each are formed at a portion corresponding to the separation region B (in particular, the enlarged separation region C in the present embodiment) in the arrangement direction. Forming the clearance structure at the portion corresponding to the separation region B in the arrangement direction reduces the contact area between the heater 22 and the heater holder 23 in the pressure direction at the portion corresponding to the separation region B in the arrangement direction. As a result, the amount of heat transfer from the heater 22 to the heater holder 23 at the portion corresponding to the separation region B is smaller than the amount of heat transfer from the heater 22 to the heater holder 23 at a portion other than the portion corresponding to the separation region B. In particular, forming the non-contact portion 23*c* configures the contact portion 23*a* and the heater 22 not to be in contact with each other in the pressure direction at the position of the non-contact portion 23*c* in the arrangement direction and can particularly reduce the amount of heat transfer from the heater 22 to the heater holder 23 at the position of the non-contact portion 23*c* in the arrangement direction. As described above, the clearance structure reduces the contact area in which the heater 22 contacts at least the part of the portion of the heater holder 23 corresponding to the separation region in the arrangement direction to be smaller than the contact area in which a portion of the heater 22 that is not the separation region contacts a portion of the heater holder 23 not corresponding to the separation region. Note that the portion of the heater holder 23 not corresponding to the separation region does not mean an entire portion of the heater holder 23 not corresponding to the separation region, and the portion of the heater 22 that is not the separation region does not mean an entire portion of the heater 22 that is not the separation region. In other words, the above-described contact area of the portion disposed on the clearance structure of the heater holder 23 in the arrangement direction is smaller than the contact area of at least a part of the portion not corresponding to the clearance structure.

The above-described structure can reduce a heat loss caused by the heat transfer from the heater 22 to the heater holder 23 at the portion of the heater holder 23 corresponding to the separation region B in the arrangement direction. Reducing the heat loss increases the temperature in the separation region B of the heater 22 and the temperature in the portion of the fixing belt 20 corresponding to the separation region B and reduce the temperature drop caused by the separation region B as illustrated in FIG. 7. Accordingly, the above-described structure can reduce the temperature unevenness of the fixing belt 20 in the arrangement direction. In particular, the heater holder 23 according to the present embodiment has the clearance structure at a position corresponding to the enlarged separation region C in the arrangement direction. Since this structure can reduce heat transfer from heater 22 to the heater holder 23 around the separation region, this structure further reduces the temperature unevenness of the fixing belt 20 in the arrangement direction. The clearance structure does not need to cover the entire separation region. The clearance structure covering at least a part of the separation region can have the above-described effect that reduces the temperature unevenness of the fixing belt 20 in the arrangement direction.

The above-described configuration according to the present embodiment including the notch 23*b* in the upstream portion of the heater holder 23 and the non-contact portion 23*c* in the downstream portion of the heater holder 23 in the sheet conveyance direction can surely design a certain amount of the contact area between the heater 22 and the heater holder 23 at the upstream portion of the heater holder 23 corresponding to the separation region B. As a result, the upstream portion of the heater holder 23 in the sheet conveyance direction can appropriately receive the pressure from the pressure roller 21 and unify pressure distribution at the entrance of the fixing nip in the arrangement direction. The uniform pressure distribution at the entrance of the fixing nip can prevent an occurrence of a crease on the sheet.

Contrary to the above embodiment, the heater holder 23 may include the non-contact portion in the upstream portion of the heater holder 23 and the notch in the downstream portion of the heater holder 23. This configuration increases pressure in a downstream portion of the fixing nip and a curvature of the fixing belt, which enables the sheet to easily separate from the fixing belt. The heater holder 23 may have the notches in both the upstream portion and the downstream portion. The widths of the notches in the direction intersecting the arrangement direction may be different each other.

Figure 13:
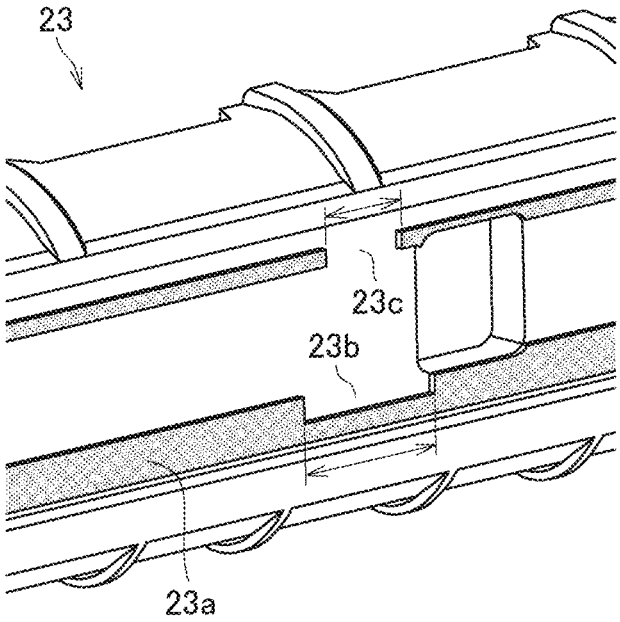
FIG. 13 is a partial perspective view of the heater holder having a clearance according to a variation.

Not only in the direction intersecting the arrangement direction but also in the arrangement direction, the range of the clearance structure in the upstream portion in the sheet conveyance direction may be designed to be different from the range of the clearance structure in the downstream portion in the sheet conveyance direction. For example, as illustrated in FIG. 13, the width of the notch 23*b* that is the clearance structure in the upstream portion in the sheet conveyance direction may be larger than the width of the non-contact portion 23*c* that is the clearance structure in the downstream portion in the sheet conveyance direction.

Figure 14:
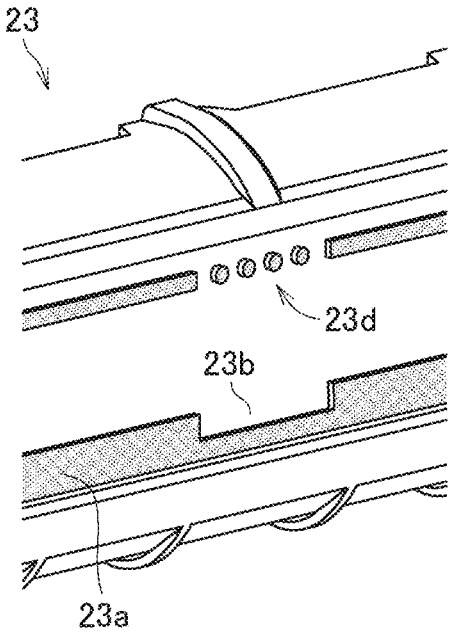
FIG. 14 is a partial perspective view of the heater holder having a clearance according to another variation.

The shape of the clearance structure is not limited to the above-described shapes. For example, as illustrated in FIG. 14, the clearance structure may be separated portions 23*d* that are contact portions arranged in the arrangement direction and disposed in the downstream portion of the contact portion 23*a* of the heater holder 23 in the sheet conveyance direction. The separated portions 23*d* in the present embodiment have substantially circular cross sections. The separated portions 23*d* separate the non-contact portion of the heater holder 23 that does not contact the heater 22 and prevents the non-contact portion from extending over a wide range in the arrangement direction. The configuration of the above-described embodiment reduces the contact area between the heater 22 and the heater holder 23 on the separation region and efficiently reduces the bending of the heater 22 when the pressure roller 21 presses against the heater 22.

In addition, the shapes of the clearance structures corresponding to the separation regions disposed in the arrangement direction do not need to be the same. The widths of the clearance structures corresponding to the separation regions disposed in the arrangement direction do not need to be the same in the arrangement direction and the direction intersecting the arrangement direction. For example, the widths of the clearance structures corresponding to the separation regions at both end portions of the heater in the arrangement direction may be larger than the width of the clearance structure corresponding to the separation region at the center portion of the heater. When the image forming apparatus is powered on, temperatures at end portions of the fixing belt 20 and the heater 22 in the arrangement direction are less likely to rise than at the center portions of the fixing belt 20 and the heater 22 because heat in the end portions is more likely to flow out than in the center portions due to heat transfer caused by contact with another component such as a side plate and heat dissipation to the atmosphere. Increasing the width of the clearance structure of the end portion in the arrangement direction reduces the heat flowing out from the end portion of the heater 22 to the end portion of the heater holder 23, which results in a decrease in the temperature difference between the center portion of the fixing belt 20 and the end portion of the fixing belt 20. As described above, the shapes, the widths in the arrangement direction, and the widths in the direction intersecting the arrangement direction of the clearance structure may be appropriately selected so as to uniform the temperature distributions in the fixing belt 20 and the heater 22 in consideration of the configuration of the fixing device 6, environments in which the image forming apparatus is used, and the like. The appropriately selected shapes and widths efficiently reduce the temperature unevenness of the fixing belt 20 and the heater 22 in the arrangement direction and decrease the bending of the heater 22.

As illustrated in FIG. 12, a range of the contact portion 23*a* in the direction intersecting the arrangement direction (the vertical direction in FIG. 12) corresponding to a range of the separation region B in the arrangement direction is outside a region in which the resistive heat generator 31 is disposed when viewed in the pressure direction (viewed in a direction perpendicular to the paper surface of FIG. 12). In other words, the contact portion 23*a* is disposed in a range that is above a dotted line L1 or below a dotted line L2 in FIG. 12. In the above, the heater 22 does not contact a portion of the heater holder 23 corresponding the separation region B between the resistive heat generators 31 that are the main heat generation portions of the heater 22. Accordingly, the above-described structure can efficiently reduce the heat transfer from the separation region B of the heater 22 to the heater holder 23 and decrease the temperature unevenness of the fixing belt 20 in the arrangement direction and the temperature unevenness of the heater 22 in the arrangement direction.

Figure 15:
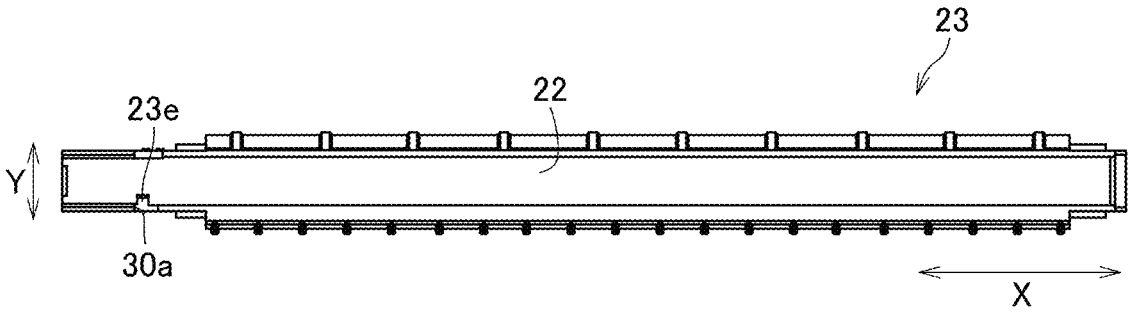
FIG. 15 is a plan view of the heater holder holding the heater.

As illustrated in FIG. 15, the heater 22 is fitted in a recess portion of the heater holder 23 (that is a portion in which the contact portion 23*a* is disposed) and held by the heater holder 23. In addition, a projection 23*e* of the heater holder 23 is fitted in a recess 30*a* of the base 30. Note that FIG. 7 and some drawings omit the recess 30*a* to simplify the drawings. The above-described structure positions the heater 22 with respect to the heater holder 23 in the arrangement direction and the direction intersecting the arrangement direction. Not that FIG. 15 omits the resistive heat generators 31, the electrodes, and the like formed on the surface of the base 30.

Figure 16:
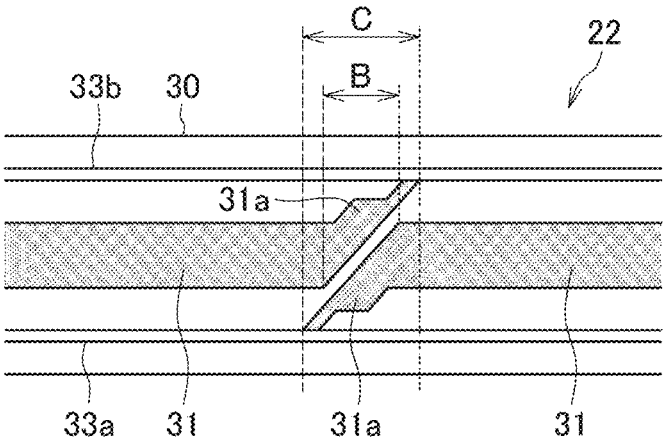
FIG. 16 is a partial plan view of the heater including resistive heat generators having enlarged widths in the separation region.

As illustrated in FIG. 16, at least one of the resistive heat generators 31 may have a wide portion 31*a* that increases the width of the resistive heat generator 31 in the direction intersecting the arrangement direction and is disposed corresponding to the range of the separation region B. The wide portion 31*a* increases the heat generation amount generated by the resistive heat generator 31 in the separation region B and decreases the temperature drops of the heater 22 and the fixing belt 20 in the separation region B. Accordingly, the above-described structure can reduce the temperature unevenness of the fixing belt 20 in the arrangement direction and the temperature unevenness of the heater 22 in the arrangement direction.

Preferably, the wide portion 31*a* is covered by the fixing nip when viewed from the pressure direction (that is a direction perpendicular to the paper surface of FIG. 16). Thus, heat generated in the wide portion 31*a* can be efficiently transmitted to the fixing nip.

The range of the fixing nip can be measured by the following method. That is, heat-resistant paint such as fluorine-based paint or silicon-based paint is applied to the surface of the heater that contacts the inner circumferential surface of the fixing belt, and the fixing nip is formed between the pressure roller and the fixing belt. Thereafter, the painted surface of the heater is observed to examine the difference in the abrasion state of the painted surface of the heater. The above-described processing damages the painted surface of the heater in the range of the fixing nip and keeps the painted surface of the heater outside the range of the fixing nip to be the initial painted surface state. As a result, the above-described method can determine which of a part of the surface of the portion of the heater is covered by the fixing nip.

Numerous additional modifications to the above-described embodiments and variations are possible. It is therefore to be understood that, within the scope of the appended claims, the disclosure of this patent specification may be practiced otherwise than as specifically described herein.

The image forming apparatus according to the present disclosure is applicable not only to the monochrome image forming apparatus illustrated in FIG. 1 but also to a color image forming apparatus, a copier, a printer, a facsimile machine, or a multifunction peripheral including at least two functions of the copier, printer, and facsimile machine.

The sheets P serving as recording media may be thick paper, postcards, envelopes, plain paper, thin paper, coated paper, art paper, tracing paper, overhead projector (OHP) transparencies, plastic film, prepreg, copper foil, and the like.

A heating device according to the present disclosure is not limited to the fixing device described in the above embodiments. The heating device according to the present disclosure is also applicable to, for example, a heating device such as a dryer to dry ink applied to the sheet, a coating device (a laminator) that heats, under pressure, a film serving as a covering member onto the surface of the sheet such as paper, and a thermocompression device such as a heat sealer that seals a seal portion of a packaging material with heat and pressure. Applying the present disclosure to the above heating device can reduce the temperature unevenness of the belt (heating component) in the arrangement direction.

The above-described embodiments are illustrative and do not limit this disclosure. Thus, numerous additional modifications and variations are possible in light of the above teachings. For example, elements and/or features of different illustrative embodiments may be combined with each other and/or substituted for each other within the scope of this disclosure.

The effects obtained by the above-described embodiment and variations are examples. The effects according to the present disclosure are not limited to the above-described effects.

What is claimed is:

1. A heating device comprising:

a heating rotator;

a pressure rotator configured to press against the heating rotator to form a nip through which a recording medium is conveyed;

a planar heater including a plurality of heat generators arranged side by side and at least one separation region between the plurality of heat generators; and a holder holding the planar heater and contacting the planar heater in a pressure direction in which the pressure rotator presses the heating rotator, the holder including at least one clearance structure configured to cause a contact area between the planar heater and a portion of the holder corresponding to the at least one separation region to be smaller than a contact area between the planar heater and a portion of the holder not corresponding to the at least one separation region, the at least one clearance structure including a surface separated from and facing the planar heater.

2. The heating device according to claim 1, wherein the planar heater includes an electrode and a conductor coupling the electrode to the plurality of heat generators, wherein each of the plurality of heat generators includes a connection portion extending in a direction intersecting an arrangement direction of the plurality of heat generators and being coupled to the conductor, and wherein the clearance structure is disposed corresponding to the connection portion.

3. The heating device according to claim 1, wherein, in a direction intersecting an arrangement direction of the plurality of heat generators, a portion of the planar heater that contacts the portion of the holder corresponding to the at least one separation region is outside a region in which the plurality of heat generators are disposed.

4. The heating device according to claim 1, wherein the clearance structure includes a non-contact portion that does not bring the holder into contact with the planar heater.

5. The heating device according to claim 1, wherein the planar heater includes a plurality of separation regions, and the holder includes a plurality of clearance structures, and wherein at least one of widths of the plurality of clearance structures in an arrangement direction of the plurality of heat generators or widths of the plurality of clearance structures in a direction intersecting the arrangement direction are different from each other.

6. The heating device according to claim 1, wherein the holder includes contact portions that contacts both end portions of the planar heater in a direction intersecting an arrangement direction of the plurality of heat generators, wherein the contact portions have clearance structures, and wherein at least one of widths of the clearance structures in the arrangement direction, widths of the clearance structures in the direction intersecting the arrangement direction, or shapes of the clearance structures are different from each other.

7. The heating device according to claim 1, wherein at least one of the plurality of heat generators includes a wide portion extending from a portion of the at least one of the plurality of heat generators corresponding to the at least one separation region in a direction intersecting an arrangement direction of the plurality of heat generators.

8. The heating device according to claim 7, wherein a nip between the heating rotator and the pressure rotator covers the wide portion.

9. A fixing device comprising the heating device according to claim 1.

10. An image forming apparatus comprising the fixing device according to claim 9.

11. The heating device according to claim 1, wherein the holder includes contact portions that contact the planar heater, the at least one clearance structure separates sections of a first contact portion of the contact portions, and a second contact portion of the contact portions includes a notch at the least one clearance structure.

* * * * *